US008463113B2

(12) United States Patent
Hwang

(10) Patent No.: US 8,463,113 B2
(45) Date of Patent: Jun. 11, 2013

(54) FAN HEATER APPLYING A CARBON FIBER RIBBON SECURED IN EACH HEATING CARTRIDGE

(76) Inventor: Gyu Eob Hwang, Duluth, GA (US)

( * ) Notice: Subject to any disclaimer, the term of this patent is extended or adjusted under 35 U.S.C. 154(b) by 241 days.

(21) Appl. No.: 12/972,797

(22) Filed: Dec. 20, 2010

(65) Prior Publication Data

US 2012/0155840 A1 Jun. 21, 2012

(51) Int. Cl.
*F24D 5/10* (2006.01)

(52) U.S. Cl.
USPC ..... 392/350; 392/347; 392/360; 392/349

(58) Field of Classification Search
None
See application file for complete search history.

(56) References Cited

U.S. PATENT DOCUMENTS

| | | | | | |
|---|---|---|---|---|---|
| 1,077,866 | A * | 11/1913 | Ball | 219/451.1 |
| 1,493,021 | A * | 5/1924 | Christoph | 219/532 |
| 1,991,935 | A * | 2/1935 | Melsom | 338/206 |
| 3,651,304 | A * | 3/1972 | Fedor | 219/200 |
| 3,673,387 | A * | 6/1972 | Drugmand et al. | 219/532 |
| 3,757,083 | A * | 9/1973 | Dietz et al. | 392/434 |
| 3,783,238 | A * | 1/1974 | Dietz et al. | 219/395 |
| 3,798,417 | A * | 3/1974 | Bittner | 219/532 |
| 3,835,435 | A * | 9/1974 | Seel | 338/280 |
| 3,883,721 | A * | 5/1975 | Paulson et al. | 219/532 |
| 3,898,426 | A * | 8/1975 | Maake | 392/350 |
| 3,912,903 | A * | 10/1975 | Northrup et al. | 392/350 |
| 4,048,472 | A * | 9/1977 | Sauer et al. | 219/388 |
| 4,100,395 | A * | 7/1978 | Ballard | 392/434 |
| 4,144,445 | A * | 3/1979 | Thweatt, Jr. | 219/532 |
| 4,151,398 | A * | 4/1979 | Maake | 219/532 |
| 4,213,033 | A * | 7/1980 | Bjarsch | 219/385 |
| 4,322,605 | A * | 3/1982 | Stimens | 219/532 |
| 4,551,614 | A * | 11/1985 | Johnson | 392/433 |
| 4,737,618 | A * | 4/1988 | Barbier et al. | 219/548 |
| 5,233,165 | A * | 8/1993 | Maumus et al. | 219/539 |
| 6,765,339 | B2 * | 7/2004 | Dieudonne et al. | 313/45 |
| 7,254,319 | B2 * | 8/2007 | Bonnin et al. | 392/423 |
| 2003/0031471 | A1 * | 2/2003 | Schneider et al. | 392/407 |
| 2006/0051078 | A1 * | 3/2006 | Bonnin et al. | 392/423 |
| 2012/0070133 | A1 * | 3/2012 | Biscuola et al. | 392/360 |

OTHER PUBLICATIONS

Derwent Summary publication 2008-A92776 of KR 2007049329A.*

* cited by examiner

*Primary Examiner* — Thor Campbell
(74) *Attorney, Agent, or Firm* — LRK Patent Law Firm

(57) ABSTRACT

A fan heater includes a main body having a suction port provided at a lower side thereof and a hot-air outlet port provided at an upper side thereof, blower provided below the hot-air outlet port within the main body, a plurality of heating cartridge holders provided on in the main body, a plurality of heating cartridges, each of the heating cartridges configured to be secured to each of the heating cartridge holders and to heat air flowing into the main body through the suction port, a carbon fiber ribbon provided in each of the heating cartridges, and an interior housing that guides the air introduced through the suction port to the hot-air outlet port.

6 Claims, 4 Drawing Sheets

FAN HEATER APPLYING A CARBON FIBER RIBBON SECURED IN EACH HEATING CARTRIDGE

BACKGROUND

1. Technical Field

The present disclosure relates to a fan heater and, more particularly, to a fan heater that employs a plurality of heating cartridges, each having a carbon fiber ribbon therein as a heat source and may achieve rapid and effective heating using hot air and far-infrared while reducing power consumption.

2. Description of the Related Art

Generally, heaters for indoor heating are classified into oil heaters, gas heaters, and electric heaters.

The oil heater or the gas heater has a more complex structure than the electric heater, causing difficulty in fabrication, and tends to pollute indoor air due to incomplete combustion of fuel. In addition, the oil heater or gas heater suffers high fire risk during injection of fuel and requires cumbersome operation for fuel injection. Particularly, a recent increase in oil prices has led to a significant increase in oil and gas costs, which burdens users of the oil heater or gas heater.

Conversely, the electric heater employs electricity as an energy source and has a simple structure, which permits easy fabrication of the heater while providing high convenience in manipulation. Additionally, the electric heater has various merits including relatively low fire risk, no requirement for frequent fuel replenishment, convenient maintenance, and the like. With such various merits, demand for electric heaters as an indoor heating means is high.

A conventional electric heater generally includes one or more transparent heat-resistant quartz tubes or opaque heat-resistant metal tubes, each of which receives a nickel chrome coil type electric heating element therein. Alternatively, the conventional electric heater includes a ceramic plate which is placed at a front position inside a case of the heater and has a tungsten wire type electric heating element received therein.

However, the electric heater including the quartz tubes or metal tubes consumes large amounts of energy, thus constituting a considerable financial burden in terms of energy expenditure. Further, since the quartz tube or metal tube has a small heat emitting area, the conventional electric heater suffers from low heat emission efficiency. Furthermore, the electric heater including the ceramic plate takes a considerable amount of time to warm to operating temperature, thereby making it difficult to achieve rapid heating.

Moreover, the conventional electric heater adopts direct heat conduction by heating air through heat emission from the quartz tube or metal tube in which the nickel chrome coil type electric heating element is received, thereby significantly deteriorating heating efficiency.

BRIEF SUMMARY

The present disclosure addresses such problems of the related art described above and an aspect of the present disclosure is to provide a fan heater that can increase heating efficiency while reducing power consumption.

Another aspect of the present disclosure is to provide a fan heater that can emit far-infrared and anions to remove toxic bacteria and dust from indoor air during heating, thereby improving user health and indoor environment.

In accordance with an aspect of the present disclosure, a fan heater includes a main body having a suction port provided at a lower side thereof and a hot-air outlet port provided at an upper side thereof, a blower provided below the hot-air outlet port within the main body, a plurality of heating cartridge holder provided in the main body, a plurality of heating cartridges, each of the heating cartridges configured to be secured to each of the heating cartridge holder and to heat air flowing into the main body through the suction port, a carbon fiber ribbon provided in each of the heating cartridges and an interior housing that guides the air introduced through the suction port to the hot-air outlet port.

In accordance with other aspect of the present disclosure, the carbon fiber ribbon is made of a carbon fiber material, emits far-infrared and anions and is arranged in the heating cartridge in a serpentine fashion.

In accordance with other aspect of the present disclosure, the heating cartridges are arranged in a stepwise fashion in the main body.

In accordance with other aspect of the present disclosure, wherein the heating cartridges having the carbon fiber ribbons provides sterilizing toxic bacteria and removing foreign matter contained in the air while the air passes through the interior housing.

In accordance with other aspect of the present disclosure, the heating cartridges arranged in the stepwise fashion on the side of the main body provide a plurality of layers of the heating cartridges.

BRIEF DESCRIPTION OF THE DRAWINGS

The above and other aspects, features and advantages of the present disclosure will become apparent from the following description of exemplary embodiments given in conjunction with the accompanying drawings, in which.

DETAILED DESCRIPTION

Exemplary embodiments of the present disclosure will now be described in detail with reference to the accompanying drawings.

Figure 1:
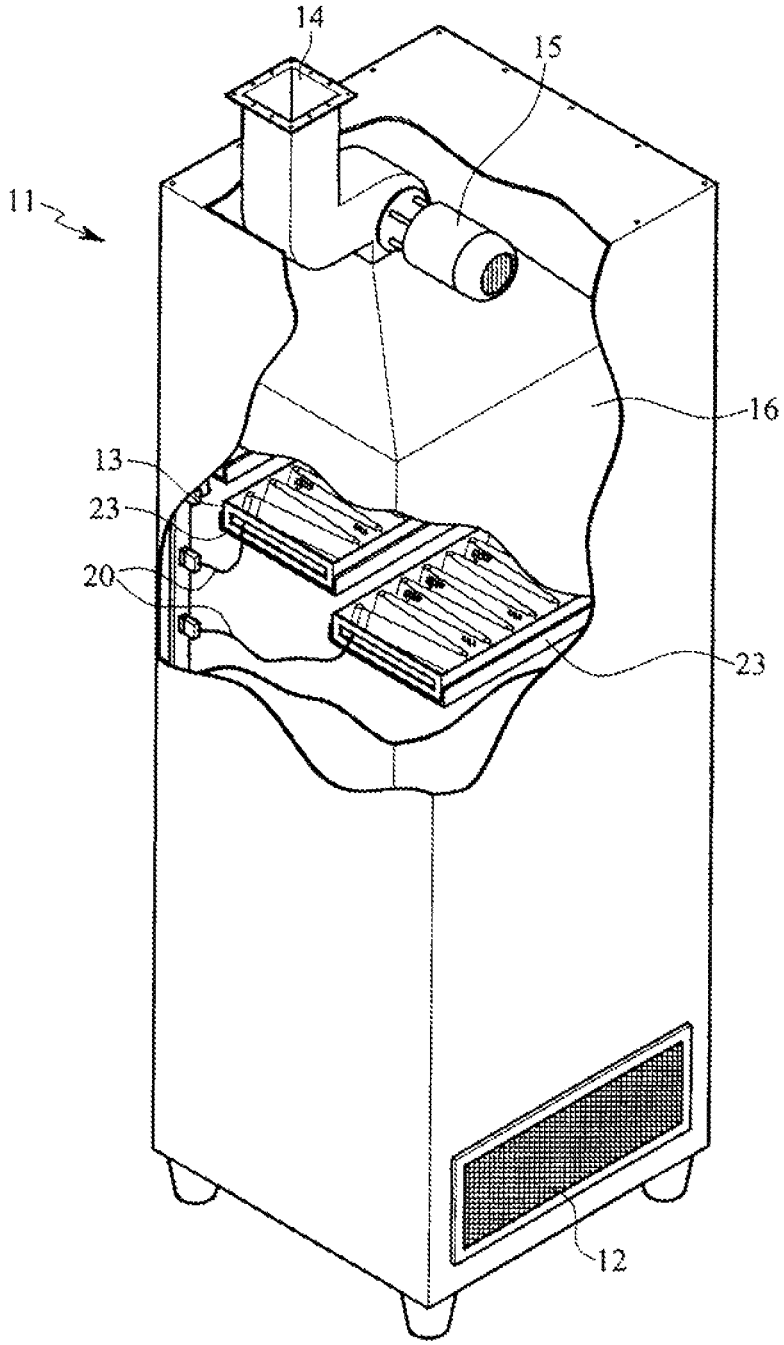
FIG. 1 is a partially cut perspective view of the fan heater according to an exemplary embodiment of the present disclosure.
Figure 2:
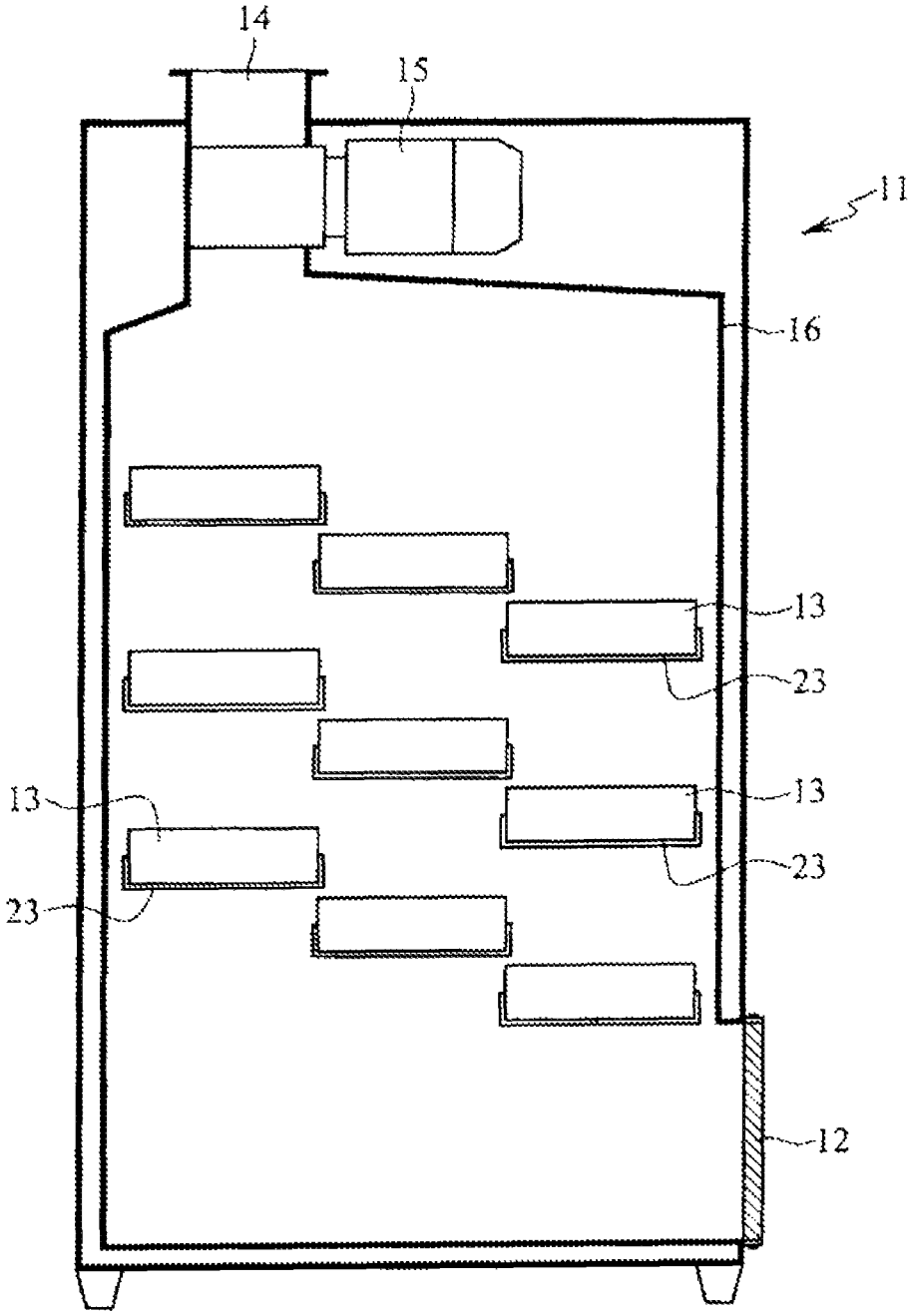
FIG. 2 is a cross-sectional view of the fan heater according to the embodiment of the present disclosure.
Figure 3:
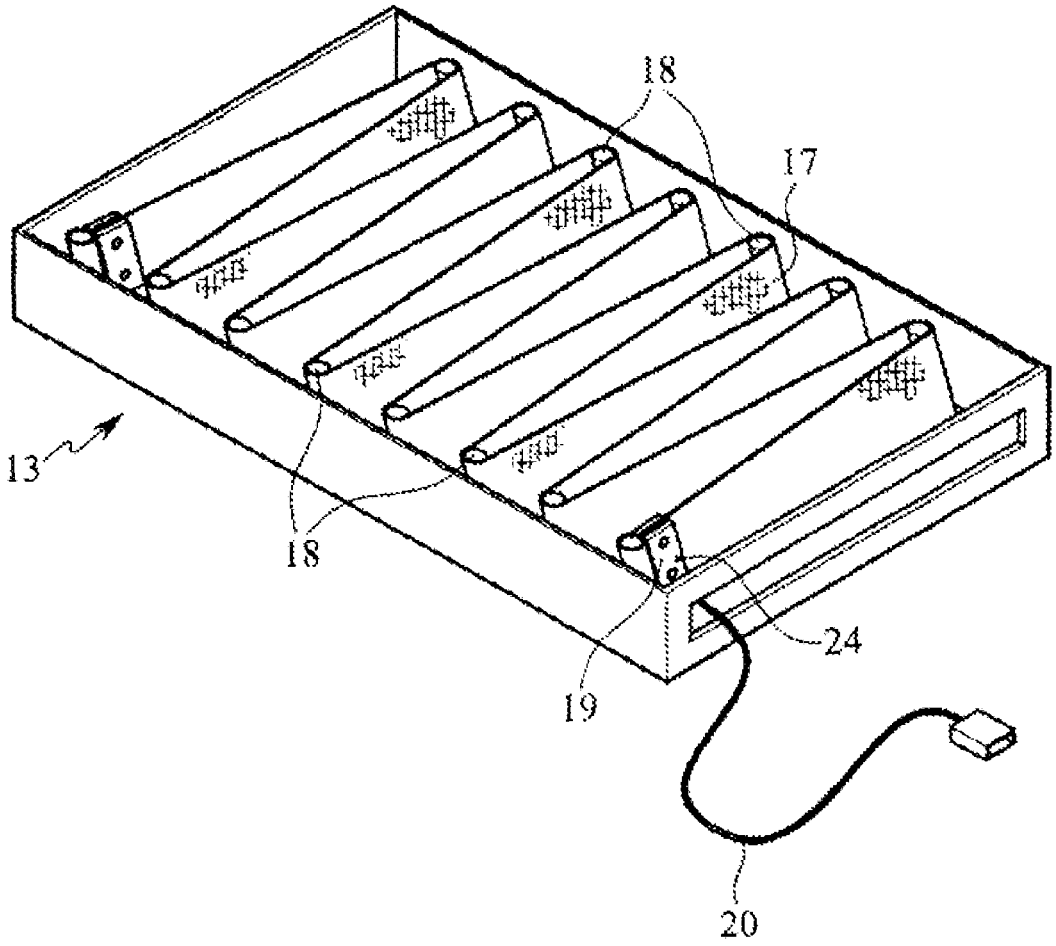
FIG. 3 is a perspective view of the heating cartridge having a carbon fiber ribbon therein
Figure 4:
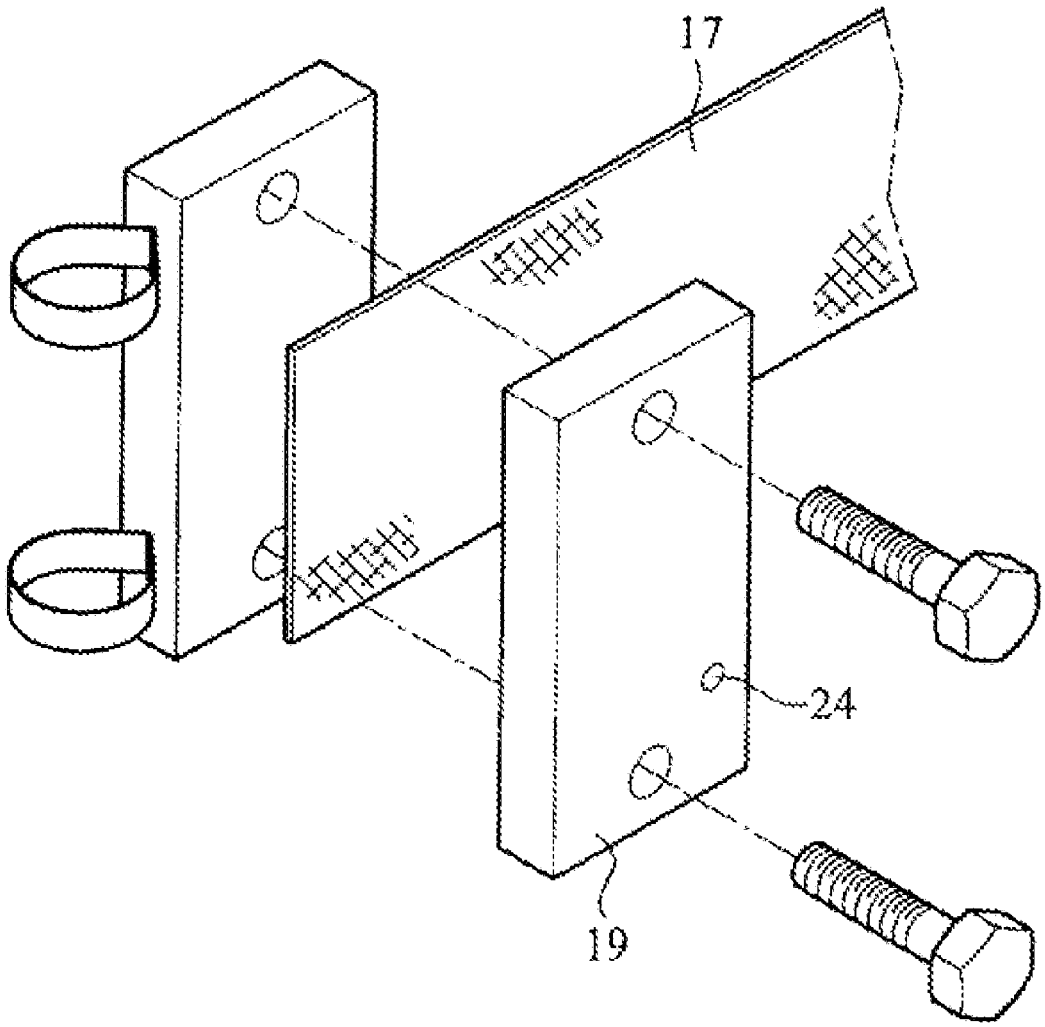
FIG. 4 is an exploded view of a carbon fiber ribbon securing member

FIG. 1 is a partially cut perspective view of the fan heater according to an exemplary embodiment of the present disclosure, FIG. 2 is a cross-sectional view of the fan heater according to the embodiment of the present disclosure, FIG. 3 is perspective view of the heating cartridge having a carbon fiber ribbon therein, and FIG. 4 is an exploded view of the carbon fiber ribbon securing member Referring to FIGS. 1 and 2, the fan heater according to the embodiment includes a main body 11, a blower 15, heating cartridges 13, and an interior housing 16.

The main body 11 serves as a casing, and includes a suction port 12 formed at a lower side thereof to suction indoor air and a hot-air outlet port 14 formed at an upper side thereof to blow hot air outside the fan heater.

The blower 15 is configured to blow the hot air heated by the heating cartridge 13 towards the hot-air outlet port 14. The blower 15 is located below the hot-air outlet port 14.

The heating cartridges 13 heat cold air flowing into the main body 11 through the suction port 12 to generate hot air while sterilizing toxic bacteria and removing or burning foreign matter or unpleasant odors in the air. The heating cartridges 13 are located above the suction port and secured to a plurality of heating cartridge holders 23. As shown in FIG. 2, each of the heating cartridges 13 has a cartridge shape and includes a carbon fiber ribbon 17 made of a carbon fiber material. Further, the heating cartridges 13 are arranged stepwise so as to guarantee efficient blowing and heating while facilitating attachment/detachment to the fan heater. In each of the heating cartridges 13, the carbon fiber ribbon 17 is bent in a serpentine fashion and secured to a cartridge frame by pins 18, which includes a metal pipe disposed at the center thereof and a non-conductive heat resistant pipe surrounding the meal pipe. Each of the heating cartridges 13 further includes fiber ribbon securing member 19 that is made of a metal plate to ensure engagement and electric conduction between the carbon fiber ribbon and the electric wire 20 and includes an electric wire connecting port 24.

The interior housing 16 is disposed inside the main body 11 to collect and guide hot air generated by the heating cartridge 13 to the hot-air outlet port. The interior housing 16 is made using a metal plate, which exhibits high reflectivity of heat and far-infrared.

Next, operation and effect of the fan heater according to this embodiment will be described with reference to the accompanying drawings.

Referring to FIG. 2, a plurality of the heating cartridges 13 are arranged stepwise in the fan heater. Here, as shown in FIG. 2, each of the heating cartridges 13 has a cartridge shape and is constituted by the carbon fiber ribbon 17, which is bent in a serpentine fashion at the pins 18 separated a constant distance from each other. Therefore, a wide contact area is created between the heating cartridges and air introduced into the main body, thereby efficiently generating large amounts of hot air in a short period of time. Further, since the heating cartridges 13 are disposed inside a metal plate exhibiting good diffuse reflection with respect to heat and far-infrared light, it is possible to provide improved hot-air blowing effects. These features of the fan heater according to the embodiment provide a significant reduction in power consumption to 30% or more as compared to a conventional electric heater, which employs a nickel chrome coil type or metal pipe type electric heating element, thereby enabling a significant reduction in energy consumption. Furthermore, since the heating cartridge can be easily attached to or detached from the fan heater, the fan heater permits very convenient maintenance.

In addition, since the heating cartridges 13 neutralize or combust various toxic bacteria, foreign matter and unpleasant odors in air flowing into the main body at a temperature of 400 Fahrenheit, the fan heater may perform purification of indoor air. Further, during heating of the indoor air, the fan heater causes the carbon fiber ribbon 17 to emit anions or far-infrared light, thereby allowing more pleasant, healthy, and environmentally friendly heating.

As such, the fan heater according to the embodiment may achieve rapid generation of hot air from a wide heat emitting area through plural heating cartridge, thereby providing more rapid and very efficient indoor heating.

Further, the fan heater according to the embodiment employs the heating cartridge as a heat source. Accordingly, the fan heater may achieve more pleasant and beneficial heating by emitting far-infrared and anions while removing various toxic bacteria, unpleasant odors, and foreign matter from indoor air.

Furthermore, the fan heater according to the embodiment may achieve a significant reduction in energy expenditure through a reduction in power consumption by efficient heating, and may be used in a wide variety of applications such as a fireplace of a living room, a small fan heater, an assistant heater for a heat pump, and the like.

Although some embodiments have been described in the present, it should be understood that these embodiments are given by way of illustration only, and that various modifications, variations, and alterations can be made without departing from the spirit and scope of the present disclosure. The scope of the present disclosure should be limited only by the accompanying claims and equivalents thereof.

What is claimed is:

1. A fan heater comprising:

a main body having a suction port provided at a lower side thereof and a hot-air outlet port provided at an upper side thereof;

a blower provided below the hot-air outlet port within the main body;

a plurality of heating cartridge holders provided in the main body;

a plurality of heating cartridges, each of the heating cartridges configured to be detachably inserted into each of the heating cartridge holders and to heat air flowing into the main body through the suction port;

a carbon fiber ribbon provided in each of the heating cartridges, the carbon fiber ribbon being a heat source; and an interior housing that guides the air introduced through the suction port to the hot-air outlet port, wherein each of the heating cartridges further comprises a plurality of pins to secure the carbon fiber ribbon bent in the serpentine fashion to the cartridge, and a face of the carbon fiber ribbon is configured to tightly wind around each of the pins.

2. The fan heater of claim 1, wherein the carbon fiber ribbon is made of a carbon fiber material, emits far-infrared and anions and is arranged in the heating cartridge in a serpentine fashion.

3. The fan heater claim 2, wherein the heating cartridges are arranged in a stepwise fashion in the main body.

4. The fan heater of claim 3, wherein the heating cartridges having the carbon fiber ribbons provides sterilizing toxic bacteria and removing foreign matter contained in the air while the air passes through the interior housing.

5. The fan heater of claim 3, wherein the heating cartridges arranged in the stepwise fashion in the main body provide a plurality of layers of the heating cartridges.

6. The fan heater of claim 2, wherein each of the heating cartridges further comprises an electric wire connecting port to provide electric power to the carbon fiber ribbon.

* * * * *